US009151566B2

(12) United States Patent
Cummings

(10) Patent No.: US 9,151,566 B2
(45) Date of Patent: Oct. 6, 2015

(54) TOY BOW AND ARROW SYSTEM WITH UV LIGHT SHIELDING

(71) Applicant: Peter Cummings, Kowloon (HK)

(72) Inventor: Peter Cummings, Kowloon (HK)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 58 days.

(21) Appl. No.: 13/902,968

(22) Filed: May 27, 2013

(65) Prior Publication Data

US 2013/0263838 A1 Oct. 10, 2013

Related U.S. Application Data

(63) Continuation-in-part of application No. 12/878,985, filed on Sep. 9, 2010, now Pat. No. 8,662,060.

(51) Int. Cl.

| | |
|---|---|
| ***F41B 3/02*** | (2006.01) |
| ***F41B 5/00*** | (2006.01) |
| ***A63F 9/02*** | (2006.01) |
| ***F41B 5/12*** | (2006.01) |
| ***F41B 7/08*** | (2006.01) |
| ***F41B 5/14*** | (2006.01) |

(52) U.S. Cl.

CPC ..... *F41B 5/0094* (2013.01); *A63F 9/0252* (2013.01); *F41B 5/12* (2013.01); *F41B 5/1484* (2013.01); *F41B 7/08* (2013.01)

(58) Field of Classification Search

CPC ..... F41B 5/0097; F41B 3/00; A63F 9/0252
USPC ..... 124/20.1, 22, 17, 23.1
See application file for complete search history.

(56) References Cited

U.S. PATENT DOCUMENTS

| | | | | |
|---|---|---|---|---|
| 4,458,658 | A | 7/1984 | Blair | |
| 5,072,715 | A * | 12/1991 | Barr | 124/20.1 |
| 5,247,920 | A | 9/1993 | Harbin | |
| 7,748,369 | B2 | 7/2010 | Chee | |
| 2012/0160224 | A1 | 6/2012 | Walterscheid | |

FOREIGN PATENT DOCUMENTS

| | | |
|---|---|---|
| CA | 2240141 | 12/1999 |
| GB | 2255289 | 11/1992 |

* cited by examiner

*Primary Examiner* — Melba Bumgarner
*Assistant Examiner* — Amir Klayman
(74) *Attorney, Agent, or Firm* — LaMorte & Associates, P.C.

(57) ABSTRACT

A toy bow assembly that is used to launch toy projectiles. The toy bow assembly includes a bow structure having a first arm section and a second arm section. Both the first arm section and the second arm section have sheathed areas that are protected from ambient light. A central area is disposed between the first arm section and the second arm section. A first elastic element extends through the first sheathed area into the central area, wherein the first sheathed area shields the first elastic element from exposure to ambient light. Likewise, a second elastic element extends through the second sheathed area and into the central area, wherein the second sheathed area shields the second elastic element from exposure to ambient light.

11 Claims, 4 Drawing Sheets

TOY BOW AND ARROW SYSTEM WITH UV LIGHT SHIELDING

RELATED APPLICATIONS

This application is a continuation-in-part of co-pending U.S. patent application Ser. No. 12/878,985, filed Sep. 9, 2010.

BACKGROUND OF THE INVENTION

1. Field of the Invention

In general, the present invention relates to toy bow and arrow systems, where a toy bow is used to launch a toy arrow projectile into flight.

2. Prior Art Description

Bow and arrow sets that are designed for children's play have existed throughout recorded history. In the modern era, toy bow and arrow sets typically have a plastic molded bow, a string and safety-tipped arrows. To ensure safety, the functional design of a toy bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard from occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of a broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly.

Many toy bows that have elastic strings use elastic strings that are made from a synthetic polymer, such as silicon, TPR or some other synthetic rubber. On the toy, such elastic strings are constantly under tension. As such, if the material of the string creeps or degrades, the elastic string will break. This stops the toy bow from being functional.

Most all plastic degrades in some fashion over time. However, it has been found that one of the fastest ways to degrade the preferred polymers used for the bowstring is to expose the bowstring to UV light. A bowstring that can last for months inside a home may only last for a few days if taken outside and left in sunlight. A toy that lasts for months is acceptable. A toy that last for days is not. Damage caused by exposure to light has therefore caused products to be returned and/or consumer's dissatisfaction with the toy manufacturer.

A need therefore exists for a toy bow and arrow design that inhibits degradation in the elastic string caused by exposure to light. This need is met by the present invention as described and claimed below.

SUMMARY OF THE INVENTION

The present invention is a toy bow assembly that is used to launch toy projectiles. The toy bow assembly includes a bow structure having a first arm section and a second arm section. Both the first arm section and the second arm section have sheathed areas that are protected from ambient light. A central area is disposed between the first arm section and the second arm section.

A first elastic element is anchored to the first arm section. The first elastic element extends through the first sheathed area into the central area, wherein the first sheathed area shields the first elastic element from exposure to ambient light. Likewise, a second elastic element is anchored to the second arm section. The second elastic element extends through the second sheathed area and into the central area, wherein the second sheathed area shields the second elastic element from exposure to ambient light. This prevents the elastic elements from degrading due to exposure of UV light contained in ambient light.

A toy projectile is provided that has extending hooks. The hooks on the projectile engage the elastic elements. When the projectile is drawn back, the elastic elements stretch and provide the spring energy needed to launch the projectile into flight when it is released.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy bow and arrow system can be embodied in many ways, only one exemplary embodiment of the present invention system is illustrated. This embodiment is selected in order to set forth the best mode contemplated for the invention. The illustrated embodiment, however, is merely exemplary and should not be considered a limitation when interpreting the scope of the appended claims.

Figure 1:
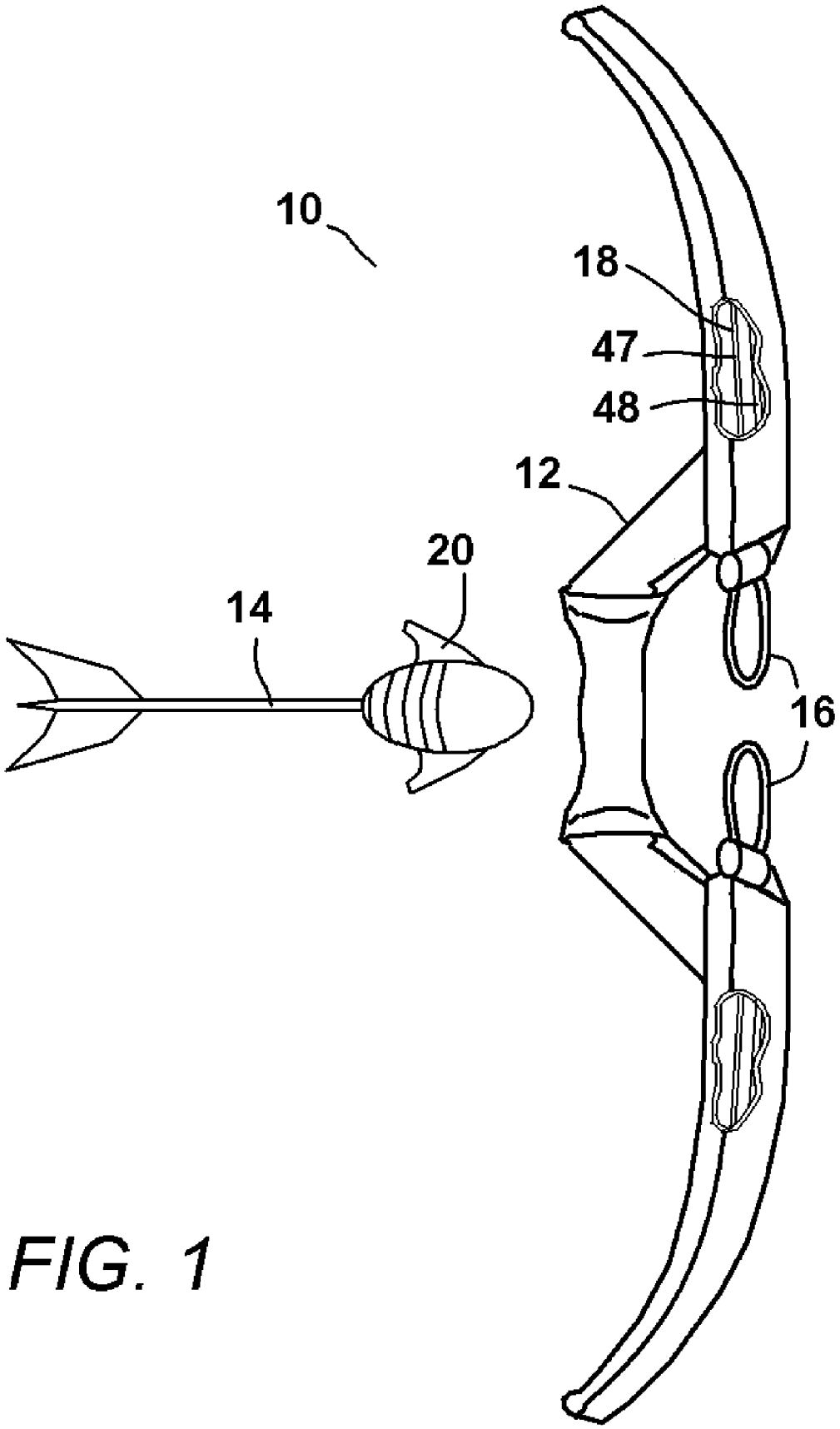
FIG. 1 is a perspective view of an exemplary embodiment of a toy bow and toy projectile in combination.

Referring to FIG. 1, a bow and arrow system 10 is shown. The bow and arrow system 10 includes a bow structure 12 and at least one arrow projectile 14. The bow structure 12 is rigid. The force used to propel the arrow projectile 14 is provided by two separate and distinct loading loops 16. The arrow projectile 14 has hook projections 20 that engage both of the loading loops 16. Elastic elements 18 extend through the loading loops 16. As a person engages an arrow projectile 14 with the loading loops 16 and pulls on the arrow projectile 14, the elastic elements 18 in the loading loops 16 stretch. Since there are two loading loops 16, the elastic element 18 in each of the loading loops 16 need only provide half the force needed to propel the arrow projectile 14 into flight. The elastic elements 18 are therefore difficult to overstretch in the proper operation of the toy. Furthermore, should either of the elastic elements 18 or loading loops 16 suddenly break, the orientation of the broken elastic elements 18 prevents the elastic elements 18 or the loading loops 16 from whipping toward the user. This dynamic is explained later in greater detail. Lastly, since the arrow projectile 14 engages two separate and distinct loading loops 16, the chances of the elastic elements 18 in both loading loops 16 breaking simultaneously are highly improbable. Accordingly, if one elastic element 18 breaks, the arrow projectile 14 will still be engaged by the other loading loop 16 and the person pulling the arrow projectile 14 back will not pull the arrow projectile 14 into himself upon the breakage of the one loading loop 16.

Figure 2:
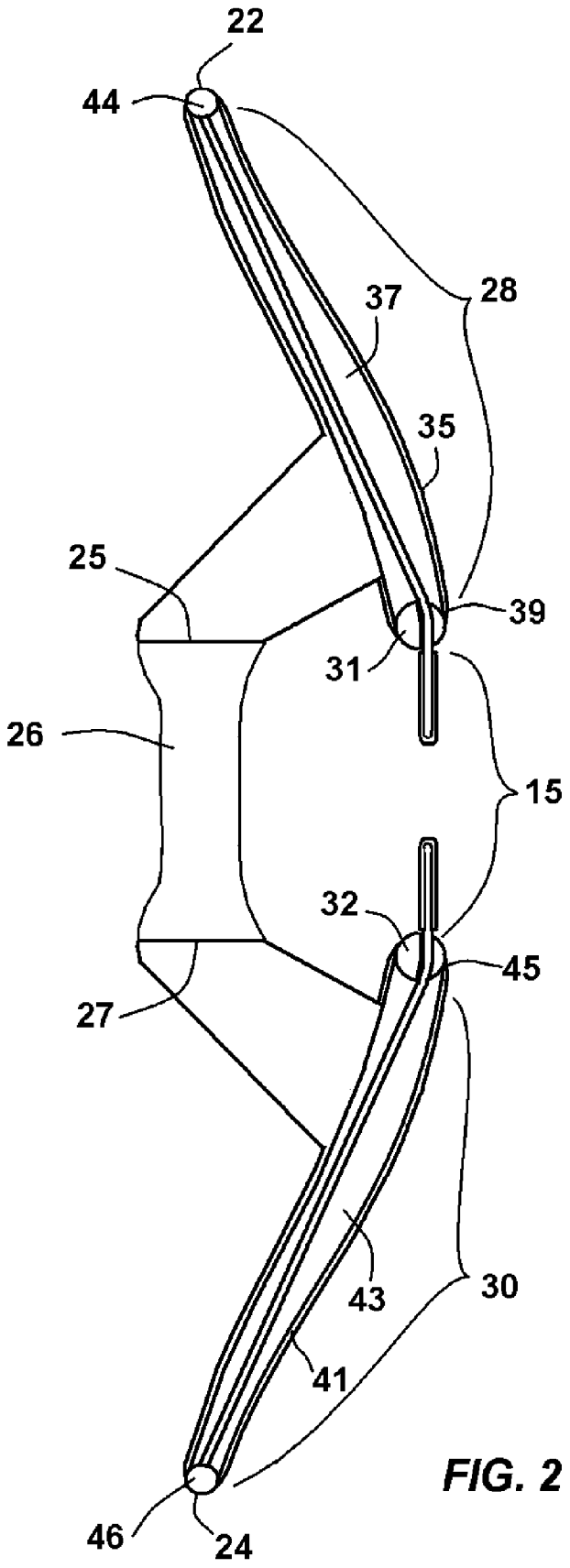
FIG. 2 is a side cross-sectional view of the toy bow shown in FIG. 1.

Referring to FIG. 2 in conjunction with FIG. 1, it can be seen that the bow structure 12 is a rigid molding. The bow structure 12 has a first end 22, a second end 24 and a handle 26 in its central region. The handle 26 has a top end 25 and a bottom end 27. A first arm section 28 is supported above the top end 25 of the handle 26. Likewise, a second arm section 30 is supported below the bottom end 27 of the handle 26. The first arm section 28 and the second arm section 30 are oriented in a common vertical plane. The handle 26 is offset from the common vertical plane so as not to interfere with the path of the arrow projectile 14. This creates an open central region 15 between the first and second arm sections 28, 30.

The first arm section 28 contains a sheath structure 35 that defines a first internal compartment 37. The first internal compartment 37 has a bottom end 39 that faces toward the open central region 15. Likewise, the second arm section 30 contains a sheath structure 41 that defines a second internal compartment 43. The second internal compartment 43 is has a top end 45 that faces toward the open central region 15. Both sheath structures 35, 41 are opaque.

Figure 3:
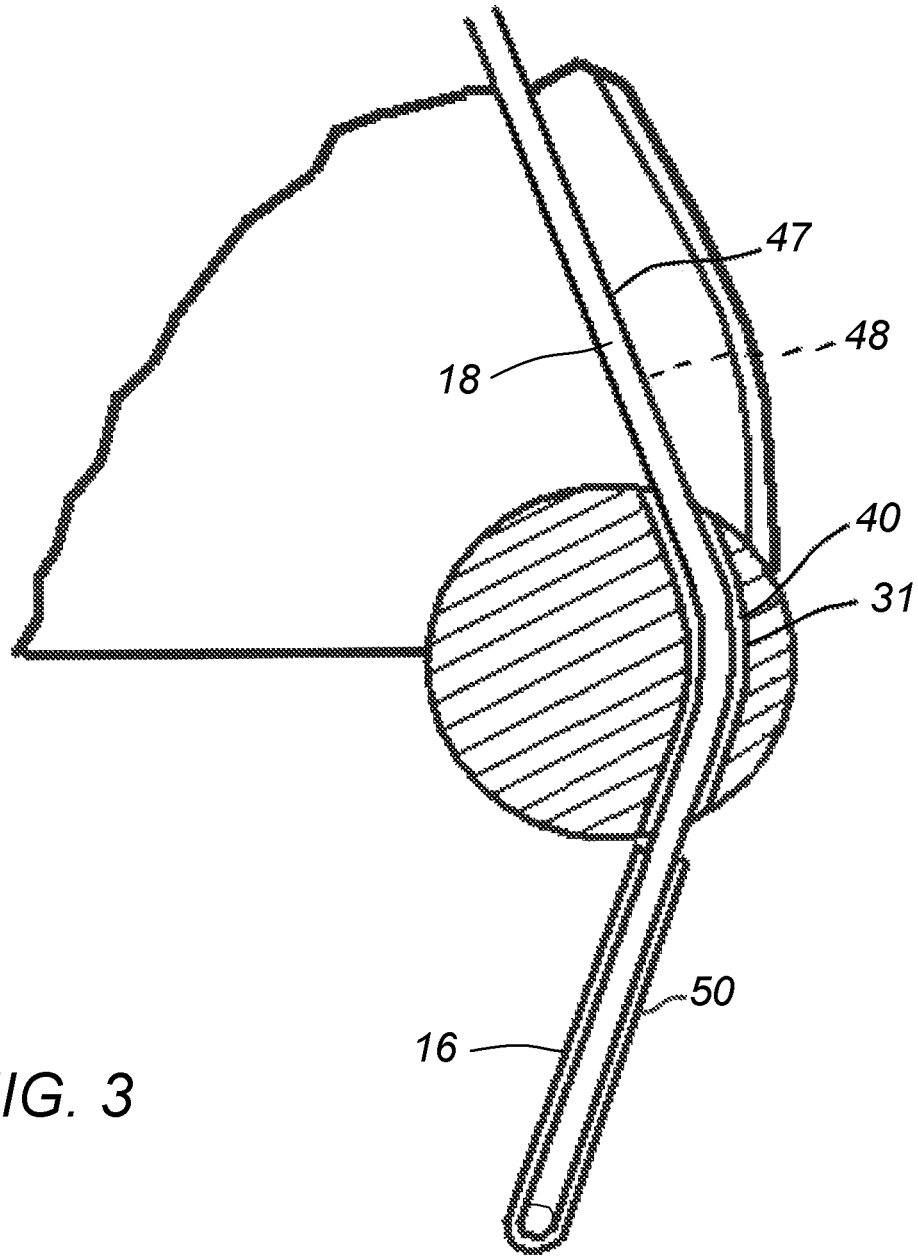
FIG. 3 is a cross-sectional view of a pivot post shown in section 3 of FIG. 2.

Two pivot post structures 31, 32 are mounted to the bow structure 12 outside the bottom opening 39 of the first sheath structure 35 and the top opening 45 of the bottom sheath structure 41. Referring now to FIG. 2 in conjunction with FIG. 3, it will be understood that although FIG. 3 shows only one of the pivot post structures 31, the description offered stands for both pivot post structures 31, 32 equally. Each pivot post structure 31, 32 defines two narrow channels 40. In FIG. 3, only one channel 40 is shown. It will be understood that a second channel lay below the shown channel 40 in a parallel configuration.

Each of the loading loops 16 is a loop structure of an elastic element 18 that creates two runs 47, 48. The runs 47, 48 of each elastic element 18 extend through the sheath structures 35, 41 and through the two pivot posts 31, 32. Each elastic element 18 has two ends. Both ends of each elastic loop 18 are affixed to anchored posts 44, 46 within the sheath structure 35, 41. Since the runs 47, 48 of each elastic element 18 extend through the sheath structures 35, 41, it will be understood that the material of the elastic elements 18 is shielded from any external light exposure until the elastic elements 18 are stretched out of the channels 40 in the pivot post structures 31, 32.

The length of the elastic element 18 has a cross section that is smaller than the diameter of the channels 40 in the pivot post structures 31, 32. In this manner, a separate run 47, 48 of the elastomeric element 18 can pass through each of the openings 40, therein keeping the two runs 47, 48 of the loop apart.

As the runs 47, 48 of the elastic element 18 pass out of the pivot post structures 31, 32, the elastic element 18 immediately passes into reinforcement tubes 50 to form the loading loops 16. The diameters of the reinforcement tubes 50 are larger than the channels 40 in the pivot post structures 31, 32. Consequently, the reinforcement tubes 50 cannot pass through the pivot post structures 31, 32. As a result, each length of the elastic element 18 is divided into two runs 47, 48. The first run 47 extends between an anchor post and the reinforcement tube 50 on the far side of the pivot post structure. The second run 48 extends from the reinforcement tube 50 back to the anchor post. The looping of the elastic element 18 between the two runs 47, 48 curves the reinforcement tubes 50 and creates the two loading loops 16.

Additionally, the presence of the reinforcement tubes 50 protects the elastic element 18 inside the loading loops 16 from exposure to light. Consequently, when the elastic elements 18 are at rest, the entire length of each of the elastic elements 18 is shielded from ambient light.

Due to the offset of the handle 26, an open central region 15 exists between the two pivot post structures 31, 32. The loading loops 16 each extend into the open central region 15 from opposite sides.

Figure 4:
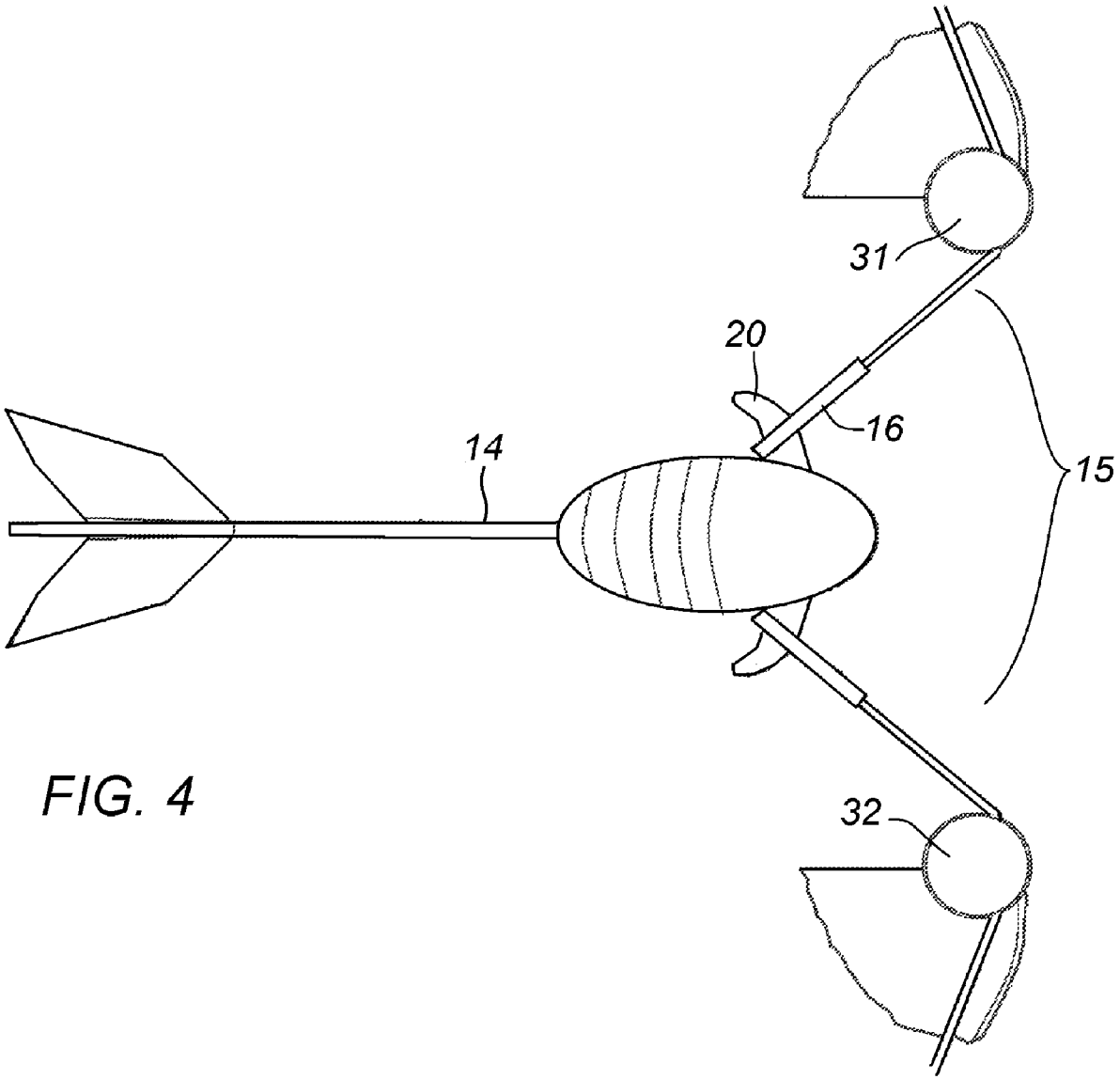
FIG. 4 shows a toy projectile engaging the loading loops within the central region of the toy bow.

Referring to FIG. 4 in conjunction with FIG. 1, it can be seen that the arrow projectile 14 has two hook elements 20 extending from opposite sides. The hook elements 20 are sized and shaped to engage the two loading loops 16 as the hook elements 20 are pulled through the open central region 15. To load the arrow projectile 14, the arrow projectile 14 is positioned within the open central region 15 so that the hook elements 20 engage the loading loops 16. Once engaged with the loading loops 16, the arrow projectile 14 is pulled in the manner of a traditional bow and arrow. As the arrow projectile 14 is pulled away from the open central region 15, the elastic elements 18 stretch. The elastic elements 18 bend around the pivot post structures 31, 32, therein enabling the loading loops 16 to move with the arrow projectile 14. This is the only time that parts of the elastic elements 18 are exposed to ambient light. This exposure lasts only for as long as the elastic elements 18 are stretched. Thus, the exposure to ambient light only lasts for a few seconds during each shot cycle.

As the elastic elements 18 stretch, they store energy. When the arrow projectile 14 is released, the elastic elements 18 retract and the arrow projectile 14 is accelerated toward the open central region 15. At the open central region 15, the loading loops 16 retract against the pivot post structures 31, 32. The momentum of the arrow projectile 14 causes the arrow projectile 14 to continue its forward movement beyond the open central region 15. This launches the arrow projectile 14 into flight as the hook elements 20 disengage the loading loops 16.

When the elastic elements 18 are stretched, they are most vulnerable to breakage. If one of the runs 47, 48 of an elastic element 18 breaks before passing through a pivot post structure 31, 32, then the speed of the contracting broken elastic element 18 is slowed by its passage through the pivot post structure 31, 32. This prevents a broken run from whipping toward a user. Furthermore, if the elastic element 18 were to break after it passes the pivot post structure 31, 32, most of the potential energy serves to move the broken elastic element 18 back toward the pivot post structure 31, 32 and away from the user.

It will be understood that the embodiment of the present invention that is illustrated and described is merely exemplary and that a person skilled in the art can make many variations to that embodiment. For instance, the bow structure can have many different ornamental shapes. The bow structure can also take the form of a crossbow. Likewise, the arrow projectiles can be configured as airplanes, rocket ships or any other flying projectile. All such embodiments are intended to be included within the scope of the present invention as defined by the claims.

What is claimed is:

1. A toy bow assembly used to launch toy projectiles, said toy bow assembly comprising:

a bow structure having a first arm section with a first sheathed area, a second arm section with a second sheathed area, and a central area disposed between said first arm section and said second arm section;

a first reinforcement tube;

a first elastic element that extends through said first reinforcement tube, said first elastic element having two opposite ends that are anchored to said first arm section, said first elastic element extending through said first sheathed area and forming a first loading loop that extends out of said first sheathed area into said central area, wherein said first sheathed area shields said first elastic element extending therethrough from exposure to ambient light, and wherein said first reinforcement tube shields said first loading loop in said central area from exposure to ambient light;

a second reinforcement tube;

a second elastic element that extends through said second reinforcement tube, said second elastic element having two opposite ends that are anchored to said second arm section, said second elastic element extending through said second sheathed area and forming a second loading loop that extends out of said second sheathed area into said central area, wherein said second sheathed area shields said second elastic element extending therethrough from exposure to ambient light, and wherein said first reinforcement tube shields said second loading loop in said central area from exposure to ambient light;

wherein said first loading loop and said second loading loop are separate and distinct elements that are spaced apart within said central area.

2. The assembly according to claim 1, further including a first pivot structure and a second pivot structure located proximate said central region on opposite sides of said central region.

3. The assembly according to claim 2, wherein said first elastic element contacts said first pivot structure proximate said first loading loop.

4. The assembly according to claim 3, further including first channels at said first pivot structure through which said first elastic element passes, wherein said first loading loop is sized to be too large to pass through said first channels at said first pivot structure.

5. The assembly according to claim 4, wherein said second elastic element contacts said second pivot structure between proximate said second loading loop.

6. The assembly according to claim 5, further including second channels at said second pivot structure through which said second elastic element passes, wherein said second loading loop is sized to be too large to pass through said second channel at said second pivot structure.

7. The assembly according to claim 1, further including a handle that is offset from said central area and is coupled to both said first arm section and said second arm section, wherein said handle, said first arm section and said second arm section form a rigid bow structure.

8. A toy launching assembly used to launch toy projectiles, said assembly comprising:

a first arm section and a second arm section that are joined together by an offset handle, wherein an open central region is disposed adjacent said handle between said first arm section and said second arm section;

a first sheath coupled to said first arm section that defines a first protected area along said first arm section;

a second sheath coupled to said second arm section that defines a second protected area along said second arm section;

a first elastic element that is anchored to said first arm section, wherein said first elastic element extends through said first protected area and forms a first loop that extends into said open central region from said first arm section;

a first reinforcement tube that protects said first loop from light in said open central region;

a second elastic element that is anchored to said second arm section, wherein said second elastic element extends through said second protected area and forms a second loop that extends into said open central region from said second arm section, wherein said first elastic element and said second elastic element are separated by a gap within said open central region; and a second reinforcement tube that protects said second loop from light in said open central region.

9. The assembly according to claim 8, further including a first pivot structure and a second pivot structure located proximate said open central region on opposite sides of said open central region.

10. The assembly according to claim 9, wherein said first elastic element bends about said first pivot structure.

11. The assembly according to claim 10, wherein said second elastic element bends about said second pivot structure.

* * * * *